US011749226B2

(12) United States Patent
Liu

(10) Patent No.: US 11,749,226 B2
(45) Date of Patent: Sep. 5, 2023

(54) SOURCE DRIVER CHIP AND DISPLAY DEVICE

(71) Applicant: TCL CHINA STAR OPTOELECTRONICS TECHNOLOGY CO., LTD., Shenzhen (CN)

(72) Inventor: Jinfeng Liu, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 392 days.

(21) Appl. No.: 17/053,715

(22) PCT Filed: Sep. 3, 2020

(86) PCT No.: PCT/CN2020/113203
§ 371 (c)(1),
(2) Date: Nov. 6, 2020

(87) PCT Pub. No.: WO2022/032756
PCT Pub. Date: Feb. 17, 2022

(65) Prior Publication Data

US 2023/0109421 A1 Apr. 6, 2023

(30) Foreign Application Priority Data

Aug. 10, 2020 (CN) ..... 202010795729.8

(51) Int. Cl.
*G09G 3/36* (2006.01)

(52) U.S. Cl.
CPC ... *G09G 3/3688* (2013.01); *G09G 2310/0248* (2013.01); *G09G 2310/08* (2013.01); *G09G 2320/041* (2013.01); *G09G 2330/021* (2013.01)

(58) Field of Classification Search
CPC ..... G09G 2310/0248; G09G 2310/027; G09G 2310/0289
See application file for complete search history.

(56) References Cited

U.S. PATENT DOCUMENTS 10,950,186 B2 * 3/2021 Hsieh ..... G09G 3/34
10,964,277 B1 * 3/2021 Hsu ..... G09G 3/344
(Continued)

FOREIGN PATENT DOCUMENTS

CN 1664910 A 9/2005
CN 101075399 A 11/2007
(Continued)

OTHER PUBLICATIONS

International Search Report in International application No. PCT/CN2020/113203, dated May 10, 2021.
(Continued)

*Primary Examiner* — Van N Chow
(74) *Attorney, Agent, or Firm* — PV IP PC; Wei Te Chung; Zhigang Ma

(57) ABSTRACT

An embodiment of the present application provides a source driver chip and a display device. Specifically, the source driver chip includes a first pre-charging module for pre-charging first data lines to a first preset voltage and pre-charging second data lines to a second preset voltage when a voltage of a first data signal is greater than a preset reference voltage.

14 Claims, 4 Drawing Sheets

(56) References Cited

U.S. PATENT DOCUMENTS

| | | | | |
|---|---|---|---|---|
| 11,205,372 | B2 * | 12/2021 | Yang | G09G 3/20 |
| 2012/0133631 | A1 | 5/2012 | Lim et al. | |
| 2015/0255027 | A1 * | 9/2015 | Wu | G09G 3/3614 345/96 |

FOREIGN PATENT DOCUMENTS

| | | | |
|---|---|---|---|
| CN | 101197121 | A | 6/2008 |
| CN | 102436789 | A | 5/2012 |
| CN | 102436791 | A | 5/2012 |
| CN | 103474019 | A | 12/2013 |
| CN | 106023920 | A | 10/2016 |
| CN | 109410854 | A | 3/2019 |

OTHER PUBLICATIONS

Written Opinion of the International Search Authority in International application No. PCT/CN2020/113203,dated May 10, 2021.
Chinese Office Action issued in corresponding Chinese Patent Application No. 202010795729.8 dated Mar. 25, 2021, pp. 1-8.

* cited by examiner

SOURCE DRIVER CHIP AND DISPLAY DEVICE

CROSS REFERENCE TO RELATED APPLICATIONS

The disclosure claims priority to International Application No. PCT/CN2020/113203, filed on Sep. 3, 2020, titled "SOURCE DRIVER CHIP AND DISPLAY DEVICE" which claims priority to Chinese patent application No. 202010795729.8, titled "SOURCE DRIVER CHIP AND DISPLAY DEVICE", filed with the National Intellectual Property Administration on Aug. 10, 2020, which is incorporated by reference in the present application in its entirety.

BACKGROUND OF INVENTION

Field of Invention

The present invention relates to a field of display technologies, and more particularly, to a source driver chip and display device.

Description of Prior Art

As dimensions of liquid crystal display (LCD) panels increasingly become larger, voltage drop caused by internal resistance known as RC loading in the large panels also becomes greater.

Efficiency of source driver chips is enhanced to ensure charging effects, which pulls up temperature of the source driver chips, that is, causes significant heat generation and makes the source driver chips vulnerable.

SUMMARY OF INVENTION

An embodiment of the application provides a source driver chip and a display device capable of reducing temperature of the source driver chip and preventing the source driver chip from damages.

An embodiment of the application provides a source driver chip applied to a display panel, wherein the display panel comprises a plurality of first data lines and a plurality of second data lines, the first data lines are configured to input a first data signal, and the second data lines are configured to input a second data signal, the first data lines and the second data lines are interleavingly arranged, the first data signal and the second data signal are not equal;

wherein the source driver chip comprises:

a first power supply module providing a power supply voltage for a first voltage range;

a second power supply module providing a power supply voltage for a second voltage range, wherein the second voltage range is symmetrical to the first voltage range with respect to a preset reference voltage;

a first pre-charging module configured to pre-charge the first data lines to a first preset voltage and the second data lines to a second preset voltage when a voltage of the first data signal is greater than the preset reference voltage, and pre-charge the first data lines to the second preset voltage and the second data lines to the first preset voltage when the voltage of the first data signal is less than the preset reference voltage, wherein the first preset voltage is greater than the second preset voltage; and a selection module configured to select one of the first power supply module or the second power supply module for connection to the first data lines based on a voltage of the first data signal, and select the other power supply module among the first power supply module or the second power supply module for connection to the second data lines based on a voltage of the second data signal, to charge the first data lines to a first preset target voltage and the second data lines to a second preset target voltage.

The disclosure further provides a display device including the source driver chip.

The source driver chip and display device in embodiments of the application include a first pre-charging module configured to pre-charge the first data lines to a first preset voltage and pre-charge the second data lines to a second preset voltage when the voltage of the first data signal is greater than the preset reference voltage, and pre-charge the first data lines to a second preset voltage and the second data lines to the first preset voltage when the voltage of the first data signal is less than the preset reference voltage. The first preset voltage is greater than the second preset voltage. Thus, magnitude of charging voltage surges is reduced, thereby reducing temperature of the source driver chip and preventing damages to the source driver chip.

BRIEF DESCRIPTION OF DRAWINGS

To clearly disclose the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF PREFERRED EMBODIMENTS

Figure 1:
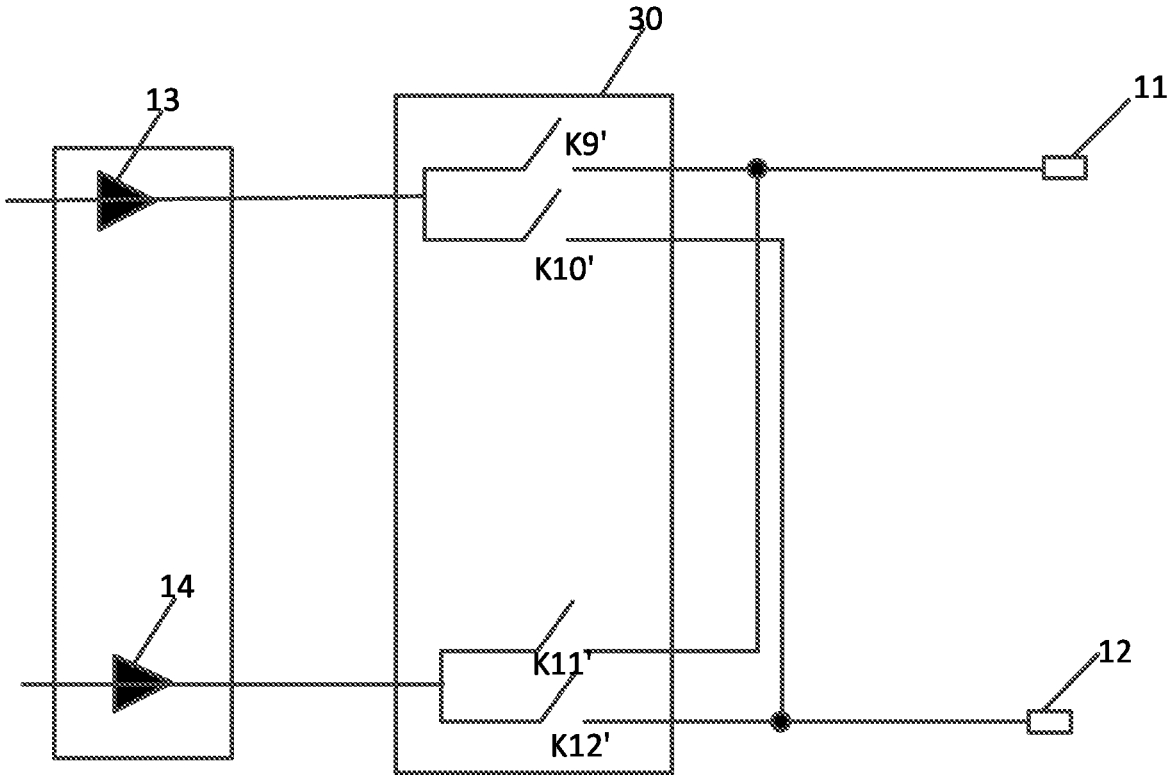
FIG. 1 is a schematic diagram showing a structural view of a current source driver chip.

The following is a clear and comprehensive description of the technical solutions in the embodiments of this application with reference to the drawings in the embodiments of the application. Obviously, the embodiments described are only part of this application, not for exhaustive illustration. Based on the embodiments of the application, other embodiments which may be easily obtained by those having ordinary skills in the art without paying additional creative effort fall within the scope of the application for protection.

In the description of the application, it is to be understood that directions or position relationships indicated by terms "center", "longitudinal", "transverse", "length", "width", "thickness", "top", "bottom", "front", "back", "left", "right", "vertical", "horizontal", "top", "bottom", "inside", "outside", "clockwise", "counterclockwise", and the similar are based on orientation or positional relationship shown in the drawings, are intended only to facilitate description of the application and simplify the description, and are not intended to indicate or imply that the device or component referred to must have a particular orientation, or be constructed or operated in a particular orientation, and are therefore not to be construed as limitations on the application. Moreover, the terms "first" and "second" are used for descriptive purposes only and are not to be understood as indicating or implying relative importance or a number of technical features indicated. Thus, a feature that is denoted by "first" or "second" may expressly or implicitly include one or more of the same features. In the description of the application, "more than one" means two or more, unless otherwise expressly and specifically indicated.

In the description of the present disclosure, it should be noted that, unless otherwise specified and defined, the terms "mounted", "connected", and "connection" should be understood broadly. For example, they may be a fixed connection, a detachable connected, indirectly connected through intermediaries, or an internal communication of two components or an interaction between two components. For those skilled in the art, the specific meanings of the above terms in the present disclosure may be understood according to specific circumstances.

In the present disclosure, unless otherwise specified and defined, a first feature "on" or "under" a second feature may include direct contact between the first and second features, and may also include that the first and second features are not in direct contact but are contacted through additional features between them. Moreover, the first feature "above", "over" and "on top of" the second feature includes the first feature directly above and indirectly above the second feature, or merely indicates that the level of the first feature is higher than that of the second feature. The first feature "below", "under" and "at the bottom of" the second feature includes the first feature directly below and indirectly below the second feature, or merely indicates that the level of the first feature is lower than the second feature.

The following disclosure provides many different implementations or examples for implementing different structures of the present disclosure. In order to simplify the disclosure of the present disclosure, the components and arrangements of the specific examples are described below. Of course, they are merely examples and are not intended to limit the invention. In addition, the present disclosure may be repeated with reference to the numerals and/or reference letters in various examples, which are for the purpose of simplicity and clarity, and do not indicate the relationship between the various implementations and/or arrangements discussed. Moreover, the present disclosure provides examples of various specific processes and materials, but those of ordinary skill in the art may be aware of the application of other processes and/or the use of other materials.

As shown in FIG. 1, a source driver chip is currently applied to a display panel. The display panel comprises a plurality of first data lines 11 and a plurality of second data lines 12. The first data lines 11 are configured to input a first data signal. The second data lines 12 are configured to input a second data signal. The first data lines and the second data lines are interleavingly arranged. The first data signal and the second data signal are not equal. The source driver chip comprises:

a first power supply module 13 providing a power supply voltage for a first voltage range, wherein the first power supply module 13 is connected to a first preset pixel data, and the power supply voltage for the first voltage range is obtained based on the first preset pixel data;

a second power supply module 14 providing a power supply voltage for a second voltage range, wherein the first voltage range, for example, may be from 8 volt (V) to 16V, the second voltage range, for example, may be from 0 to 8V, the second power supply module 14 is connected to a second preset pixel data, and the power supply voltage for the second voltage range is obtained based on the second preset pixel data; and a selection module 30 comprising a first switch K9', a second switch K10', a third switch K11', and fourth switch K12', wherein one end of the first switch K9' and one end of the second switch K10' are both connected to an output terminal of the first power supply module 13, and the other end of the first switch K9' is connected to the first data lines 11. The other end of the second switch K10' is connected to the second data lines 12.

One end of the third switch K11' and one end of the fourth switch K12' are both connected to an output terminal of the second power supply module 14, and the other end of the third switch K11' is connected to the first data lines 11. The other end of the fourth switch K12' is connected to the second data lines 12.

When a voltage of the first data signal is greater than a voltage of the second data signal, K9' and K12' are closed, and K10' and K11' are opened, so that brightness of pixels corresponding to the first data lines is greater than brightness of pixels corresponding to the second data lines. When the voltage of the second data signal is greater than the voltage of the first data signal, K10' and K11' are closed, and K9' and K12' are opened, so that the brightness of the pixels corresponding to the first data lines is less than the brightness of the pixels corresponding to the second data lines.

Figure 2:
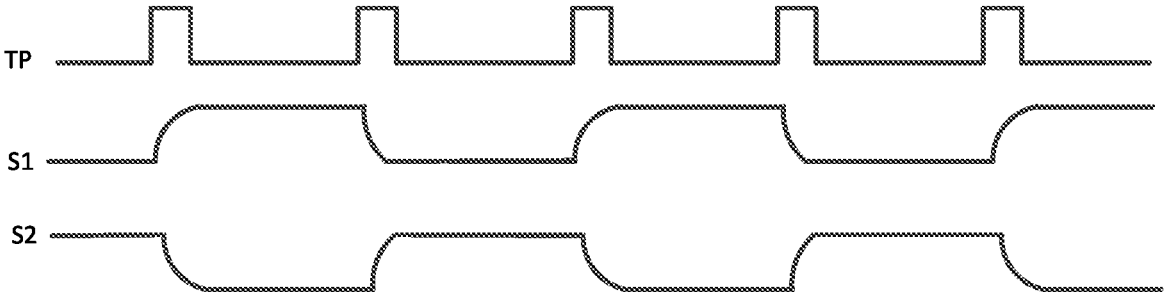
FIG. 2 is a schematic diagram showing timing sequences of one of a plurality of signals in the current source driver chip.

As shown in FIG. 2, TP indicates a touch signal, S1 indicates a data signal input from the first data lines 11, and S2 indicates a data signal input from the second data lines 12. In a normal condition, the first data lines 11 need to be charged from 8V to 16V during a charging process, and the second data lines 12 need to be discharged from 8V to 0V during a discharging process, thus increasing charging efficiency of the source driver chip.

Figure 3:
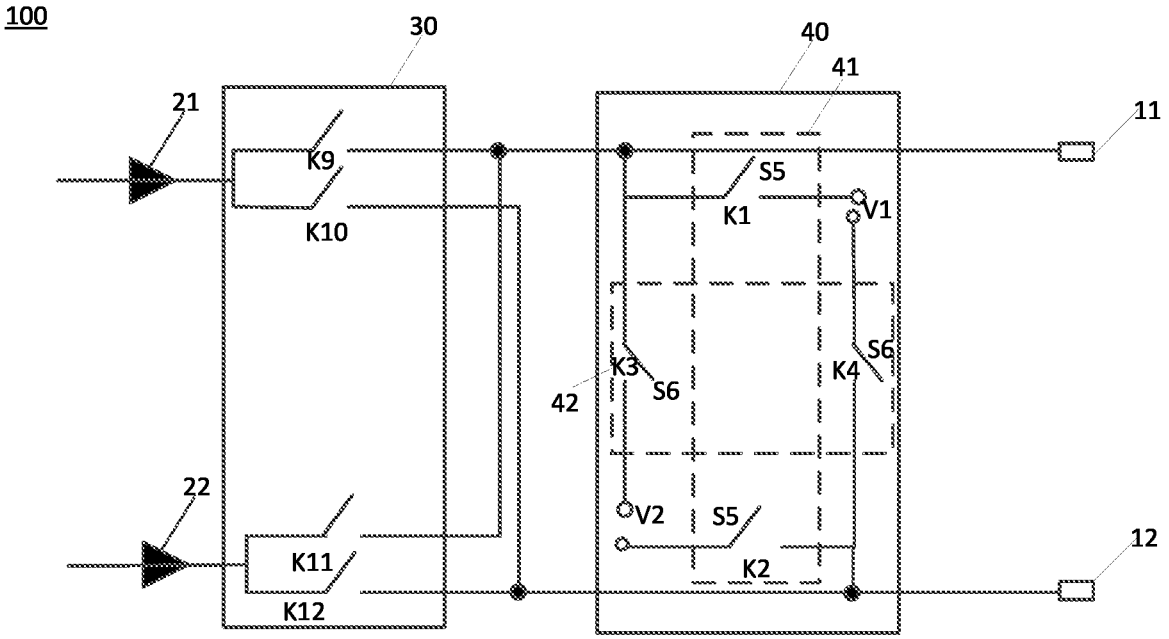
FIG. 3 is a schematic diagram showing a structural view of a source driver chip according to an embodiment of the present disclosure.
Figure 4:
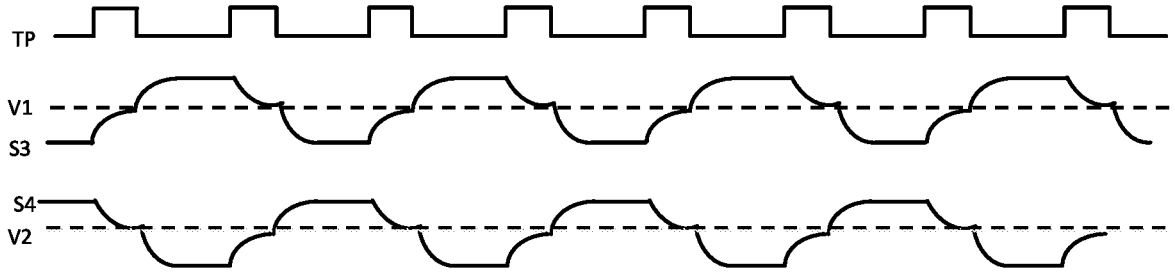
FIG. 4 is a schematic diagram showing timing sequences of one of a plurality of signals in the source driver chip of FIG. 3.

With reference to FIG. 3 to FIG. 4, FIG. 3 is a schematic diagram showing a structural view of a source driver chip according to an embodiment of the disclosure.

As shown in FIG. 3, a source driver chip 100 is applied to a display panel. The display panel comprises a plurality of first data lines 11 and a plurality of second data lines 12. The first data lines 11 are configured to input a first data signal, and the second data lines 12 are configured to input a second data signal. The first data lines 11 and the second data lines 12 are interleavingly arranged, and the first data signal 11 and the second data signal 12 are not equal.

The source driver chip 100 comprises a first power supply module 21, a second power supply module 22, a selection module 30, and a first pre-charging module 40.

The first power supply module 21 provides a power supply voltage for a first voltage range.

The second power supply module 22 provides a power supply voltage for a second voltage range. The second voltage range is symmetrical to the first voltage range with respect to a preset reference voltage. In one embodiment, the first voltage range is, for example, 8 V to 16 V, the second voltage range is, for example, 0 V to 8 V, and the preset reference voltage is 8 V. It is understood that the first voltage range and the second voltage range are not limited hereto, and can be set as required.

The selection module 30 selects one of the first power supply module 21 or the second power supply module 22 for connection to the first data lines 11 based on a voltage of the first data signal, and selects the other power supply module among the first power supply module 21 or the second power supply module 22 for connection to the second data lines 12 based on a voltage of the second data signal, to charge the first data lines to a first preset target voltage and the second data lines to a second preset target voltage. The first preset target voltage is a maximum value of the voltage of the first data signal, and the second preset target voltage is a maximum value of the voltage of the second data signal. For example, the voltage of the first data signal is greater than the voltage of the second data signal, the first preset target voltage is 16 V and the second preset target voltage is 8 V. In one embodiment, the selection module 30 comprises a ninth switch element K9, a tenth switch element K10, an eleventh switch element K11, and a twelfth switch element K12.

An input terminal of the ninth switch element K9 and an input terminal of the tenth switch element K10 are both connected to the first power supply module 21. A control terminal of the ninth switch element K9 is connected to the first data signal, and an output terminal of the ninth switch element K9 is connected to the first data lines 11.

A control terminal of the tenth switch element K10 is connected to the second data signal, and an output terminal of the tenth switch element K10 is connected to the second data lines 12.

An input terminal of the eleventh switch element K11 and an input terminal of the twelfth switch element K12 are connected to the second power supply module 22, and a control terminal of the eleventh switch element K11 is connected to the first data signal. A control terminal of the twelfth switch element K12 is connected to the second data signal. An output terminal of the eleventh switch element K11 is connected to the first data lines 11. An output terminal of the twelfth switch element K12 is connected to the second data lines 12.

The first pre-charging module 40 pre-charges the first data lines 11 to a first preset voltage V1 and the second data lines 12 to a second preset voltage V2 when a voltage of the first data signal is greater than the preset reference voltage, and pre-charges the first data lines 11 to the second preset voltage V2 and the second data lines 12 to the first preset voltage V1 when the voltage of the first data signal is less than the preset reference voltage. The first preset voltage is greater than the second preset voltage.

In an embodiment, to further reduce temperature of the chip, the first pre-charging module 40 comprises a first pre-charging unit 41 and a second pre-charging unit 42.

The first pre-charging unit 41 is configured to pre-charge the first data lines 11 to the first preset voltage V1 and the second data lines 12 to the second preset voltage V2 under control of a first control signal S5. The first control signal S5 is generated based on a difference between the voltage of the first data signal and the preset reference voltage.

The second pre-charging unit 42 is configured to pre-charge the first data lines 11 to the second preset voltage V2 and the second data lines 12 to the first preset voltage V1 under control of a second control signal S6. The second control signal S6 is generated based on a difference between a voltage of the second data signal and the preset reference voltage. The first control signal S5 and the second control signal S6 have opposite voltage levels.

In an embodiment, to further reduce the temperature of the chip, the first pre-charging unit 41 comprises a first switch element K1 and a second switch element K2.

An input terminal of the first switch element K1 is connected to the first preset voltage V1, an output terminal of the first switch element K1 is connected to the first data lines 11, a control terminal of the first switch element K1 and a control terminal of the second switch element K2 are connected to the first control signal S5.

An input terminal of the second switch element K2 is connected to the second preset voltage V2, and an output of the second switch element K2 is connected to the second data lines 12.

In an embodiment, to further reduce the temperature of the chip, the second pre-charging unit 42 comprises a third switch element K3 as well as a fourth switch element K4.

An input terminal of the third switch element K3 is connected to the second preset voltage V2. A control terminal of the third switch element K3 and a control terminal of the fourth switch element K4 are both connected to the second control signal S6. An output terminal of the third switch element K3 is connected to the first data lines 11.

An input terminal of the fourth switch element K4 is connected to the first preset voltage V1, and an output terminal of the fourth switch element K4 is connected to the second data lines 12.

In an embodiment, to further reduce the temperature of the chip, when the voltage of the first data signal is greater than the preset reference voltage, the first control signal S5 is at an effective voltage level, and the second control signal S6 is at an ineffective voltage level.

When the voltage of the second data signal is greater than the preset reference voltage, the second control signal S6 is at an effective voltage level, and the first control signal S5 is at an ineffective voltage level. The effective voltage level is a level that triggers the switch element to close, and the ineffective voltage level is a level that triggers the switch element to open. That is, when the voltage of the first data signal is greater than the voltage of the second data signal, the first switch element K1 and the second switch element K2 are closed and the third switch element K3 and the fourth switch element K4 are opened; when the voltage of the first data signal is less than the voltage of the second data signal, the first switch element K1 and the second switch element K2 are opened and the third switch element K3 and the fourth switch element K4 are closed.

In an embodiment, for example, the voltage of the first data signal is greater than the preset reference voltage, the first preset target voltage is 16 V, and the second preset target voltage is 8 V. As shown in FIG. 4, S3 indicates the first data signal and S4 indicates the second data signal. When a rising edge of the touch signal arrives, the first control signal S5 is at the effective voltage level, the first switch element K1 and the second switch element K2 are closed, and the third switch element K3 and the fourth switch element K4 are opened.

As shown in FIG. 4, normally the first data lines 11 need to be charged from 8 V to V1 and then from V1 to 16 V during a charging process, and drops from 16 V to V1 and then from V1 to 8 V during a discharging process. In one embodiment, the first preset voltage V1 may be ¾ or ¼ of the highest voltage of the first data signal and the second data signal. That is, the first preset voltage lies within the first voltage range.

The second data lines 12 are charged from 0 V to V2 and then from V2 to 8 V during a charging process, and needs to be discharged from 8 V to V2 and then from V2 to 0 V during a discharging process. Thus, magnitude of increases in the charging voltage is reduced, thereby reducing the temperature of the source driver chip and preventing damage to the source driver chip. In an embodiment, the second preset voltage V2 is ¼ or 8/1 of the highest voltage of the second data signal. The second preset voltage lies within the range of the first voltage.

When the first preset voltage is ¾ of the highest voltage of the first data signal, the second preset voltage V2 is ¼ of the highest voltage of the second data signal. When the first preset voltage is ¼ of the highest voltage of the first data signal, the second preset voltage V2 is ⅛ of the highest voltage of the first data signal and the second data signal. Values of the first preset voltage and the second preset voltage are not limited hereto. The maximum voltage in the first data signal and the second data signal may be, for example, 16 V.

Note that when the voltage of the first data signal is less than the preset reference voltage, when the rising edge of the touch signal arrives, the second control signal S6 is at an effective voltage level, the first switch element K1 and the second switch element K2 are opened, the third switch element K3 and the fourth switch element K4 are closed. The switch elements are not limited to the switches in FIG. 3, but may also be other elements such as thin-film transistors with similar specific working processes, which are not repeated here.

It of course can be understood that the structure of the first pre-charging module is not limited to this.

Figure 5:
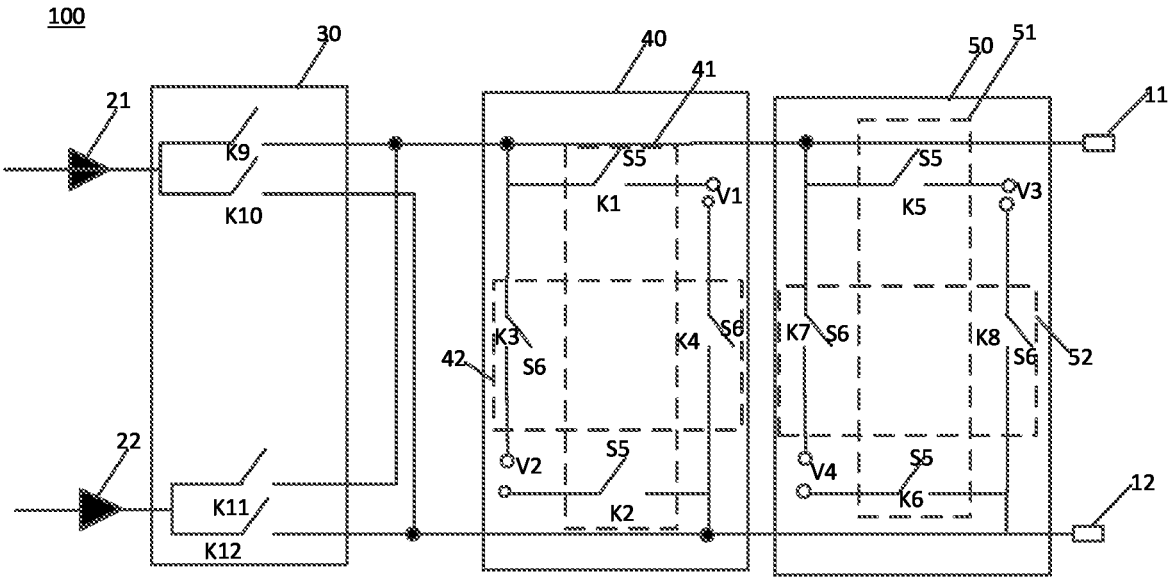
FIG. 5 is a schematic diagram showing a structural view of a source driver chip according to another embodiment of the present disclosure.
Figure 6:
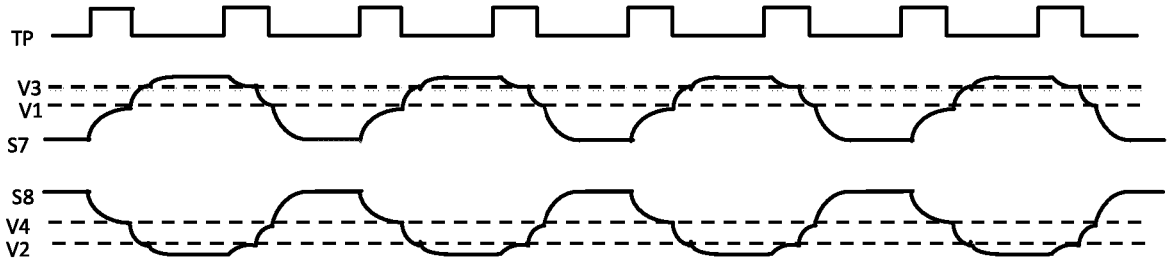
FIG. 6 is a schematic diagram showing timing sequences of one of a plurality of signals in the source driver chip of FIG. 5.

With reference to FIG. 5 and FIG. 6, FIG. 5 is a schematic diagram showing a structural view of a source driver chip according to another embodiment of the disclosure.

As shown in FIG. 5, the source driver chip of the present embodiment differs from the previous embodiment in that the source driver chip 100 of the present embodiment further includes a second pre-charging module 50.

The second pre-charging module 50 is configured to charge the first data lines 11 from the first preset voltage V1 to the third preset voltage V3 and the second data lines 12 from the second preset voltage V2 to the fourth preset voltage V4 when the voltage of the first data signal is greater than the preset reference voltage; and charge the first data lines 11 from the second preset voltage V2 to the fourth preset voltage V4 and charge the second data lines 12 from the first preset voltage V1 to the third preset voltage V3 when the voltage of the first data signal is less than the preset reference voltage, wherein the third preset voltage V3 is greater than the first preset voltage V1, the fourth preset voltage V4 is greater than the second preset voltage V2, and the fourth preset voltage V4 is less than the third preset voltage V3.

The second pre-charging module 50 includes a third pre-charging unit 51 and a fourth pre-charging unit 52.

The third pre-charging unit 51 is configured to charge the first data lines from the first preset voltage V1 to the third preset voltage V3 and the second data lines from the second preset voltage V2 to the fourth preset voltage V4 under control of the first control signal S5.

The fourth pre-charging unit 52 is configured to charge the first data lines 11 from the second preset voltage V2 to the fourth preset voltage V4 and to charge the second data lines 12 from the first preset voltage V1 to the third preset voltage V3 under control of the second control signal S6.

In one embodiment, the third pre-charging unit 51 may include a fifth switch element K5 and a sixth switch element K6.

An input terminal of the fifth switch element K5 is connected to the third preset voltage V3, an output terminal of the fifth switch element K5 is connected to the first data lines 11, and control terminals of the fifth switch element K5 and the sixth switch element K6 are both connected to the first control signal S5.

An input terminal of the sixth switch element K6 is connected to the fourth preset voltage V4. An output terminal of the sixth switch element K6 is connected to the second data lines 12.

In an embodiment, the fourth pre-charging unit 52 may comprise a seventh switch element K7 as well as an eighth switch element K8.

An input terminal of the seventh switch element K7 is connected to the fourth preset voltage V4, a control terminal of the seventh switch element K7 and a control terminal of the eighth switch element K8 are both connected to the second control signal S6. An output of the seventh switch element K7 is connected to the first data lines 11.

An input terminal of the eighth switch element K8 is connected to the third preset voltage V3, and an output terminal of the eighth switch element K8 is connected to the second data lines 12.

In an embodiment, the voltage of the first data signal is greater than the preset reference voltage, the first preset target voltage is 16 V, and the second preset target voltage is 8 V. As shown in FIG. 6, S7 indicates the first data signal, and S8 indicates the second data signal. When a rising edge of the touch signal comes, the first control signal S5 is at effective voltage level, the first switch element K1, the second switch element K2, the fifth switch element K5, and the sixth switch element K6 are closed, and the third switch element K3, the fourth switch element K4, the seventh switch element K7, and the eighth switch element K8 are opened. As shown in FIG. 6, the first data lines 11 normally are charged from 8 V to V1, and from V1 to V3 in charging process, and are charged from V3 to 16 V, or are discharged from 16 V to V3, from V3 to V1, and from V1 to 8 V in a discharging process. In one embodiment, the third preset voltage V3 is ⅝ of the highest voltage of the first data signal and the second data signal.

The second data lines 12 are charged from 0 V to V2, then from V2 to V4, then from V4 to 8 V during a charging process, and discharged from 8 V to V4, then from V4 to V2, then from V2 to 0 V during a discharging process. Thus, magnitude of the increases in charging voltage is reduced, thereby further reducing the temperature of the source driver chip and preventing damage to the source driver chip. In an embodiment, the fourth preset voltage V4 is ⅜ of the highest voltage in the first data signal and the second data signal. Values of the third preset voltage and the fourth preset voltage are not limited hereto.

Note that when the voltage of the first data signal S7 is less than the voltage of the second data signal S8, upon a rising edge of the touch signal, the first switch element K1, the second switch element K2, fifth switch element K5, and sixth switch element K6 are opened, and the third switch element K3, fourth switch element K4, seventh switch element K7, and eighth switch element K8 are closed. The switch elements are not limited to the switches shown in FIG. 5, and may also be other components such as thin-film transistors.

It can be of course understood that the structure of the second pre-charging module is not limited hereto.

Figure 7:
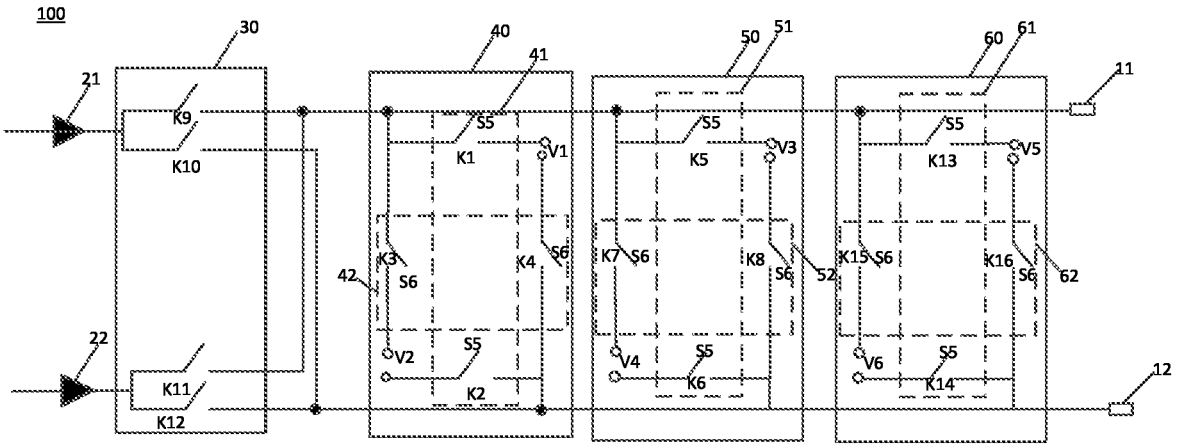
FIG. 7 is a schematic diagram showing a structural view of a source driver chip according to still another embodiment of the present disclosure.
Figure 8:
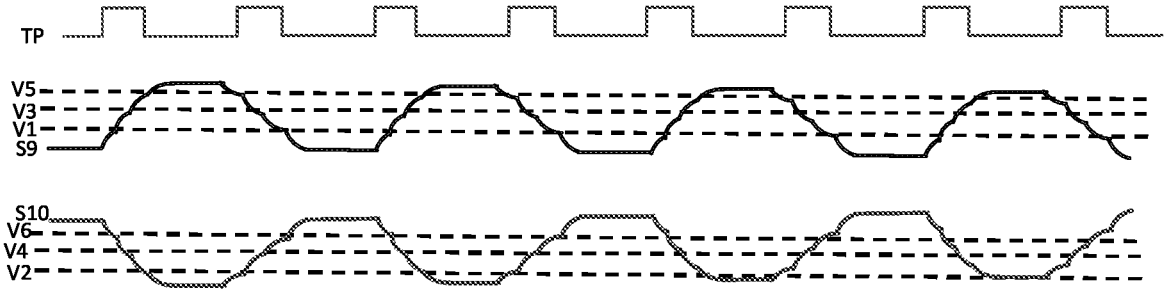
FIG. 8 is a schematic diagram showing timing sequences of one of a plurality of signals in the source driver chip of FIG. 7.

Referring to FIGS. 7 to 8, FIG. 7 is a schematic diagram showing a structural view of a source driver chip according to still another embodiment of the disclosure.

As shown in FIG. 7, the source driver chip of the present embodiment differs from the previous embodiment in that the source driver chip 100 of the present embodiment further includes a third pre-charging module 60.

The third pre-charging module 60 includes a fifth pre-charging unit 61 and a sixth pre-charging unit 62.

The fifth pre-charging unit 61 is configured to charge the first data lines 11 from the third preset voltage to the fifth preset voltage and charge the second data lines from the fourth preset voltage to the sixth preset voltage under control of the first control signal S5.

The sixth pre-charging unit 62 is configured to charge the first data lines from the fourth preset voltage to the sixth preset voltage and charge the second data lines from the third preset voltage to the fifth preset voltage under control of the second control signal.

In one embodiment, the fifth pre-charging unit 61 may comprise a thirteenth switch element K13 and a fourteenth switch element K14.

An input terminal of the thirteenth switch element K13 is connected to the fifth pre-charge voltage V5. An output terminal of the thirteenth switch element K13 is connected to the first data lines 11. Control terminals of the thirteenth switch element K13 and the fourteenth switch element K14 are both connected to the first control signal S5.

An input terminal of the fourteenth switch element K14 is connected to the sixth pre-charge voltage V6. An output terminal of the fourteenth switch element K14 is connected to the second data lines 12.

The sixth pre-charging unit 62 comprises a fifteenth switch element K15 as well as a sixteenth switch element K16.

An input terminal of the fifteenth switch element K15 is connected to the sixth preset voltage V6. A control terminal of the fifteenth switch element K15 and a control terminal of the sixteenth switch element K16 are both connected to the second control signal S6. An output terminal of the fifteenth switch element K15 is connected to the first data lines 11.

An input terminal of the sixteenth switch element K16 is connected to the fifth preset voltage V5, and an output terminal of the sixteenth switch element K16 is connected to the second data lines 12.

Specifically, the fifth preset voltage V5 is greater than the third preset voltage V3, the sixth preset voltage V6 is greater than the fourth preset voltage V4, and the sixth preset voltage V6 is less than the fifth preset voltage V5.

On the basis of the second embodiment, for example, the voltage of the first data signal is greater than the voltage of the second data signal. As shown in FIG. 8, S9 indicates the first data signal, and S10 indicates the second data signal. When a rising edge of the touch signal arrives, the first control signal S5 is at an effective voltage level, the first switch element K1, the second switch element K2, fifth switch element K5, sixth switch element K6, thirteenth switch element K13, and fourteenth switch element K14 are closed, and third switch element K3, fourth switch element K4, seventh switch element K7, eighth switch element K8, the fifteenth switch element K15 as well as the sixteenth switch element K16 are opened. As shown FIG. 8, the first data lines 11 normally needs to be charged from 8 V to V1, then from V1 to V3, then from V3 to V5, then from V5 to 16 V, or be discharged from 16 V to V5, then from V5 to V3, then from V3 to V1, then from V3 to 8 V. In one embodiment, the fifth predetermined voltage V5 is ⅞ of the highest voltage in the first data signal and the second data signal.

The second data lines 12 are charged from 0 V to V2, then from V2 to V4, then from V4 to V6, then from V6 to 8 V during a charging process, and discharged from 8 V to V6, then from V6 to V4, then from V4 to V2, and then from V2 to 0 V in a discharging process, thus to further reduce the temperature of the source driver chip and prevent damage to the source driver chip. In one embodiment, the sixth preset voltage V6 is ⅝ of the highest voltage of the second data signal. Values of the fifth preset voltage and the sixth preset voltage are not limited hereto.

Note that when the voltage of the first data signal is less than the voltage of the second data signal, upon a rising edge of the touch signal, the first switch element K1, the second switch element K2, fifth switch element K5, sixth switch element K6, thirteenth switch element K13, and fourteenth switch element K14 are opened, and third switch element K3, fourth switch element K4, seventh Switch element K7, eighth switch element K8, fifteenth switch element K15 and sixteenth switch element K16 are closed. The switch elements are not limited to the switches shown in FIG. 7, and may also include other components such as thin-film transistors.

An embodiment of the disclosure also provides a display device. In one embodiment, the display device may include any of the source driver chips described above. In one embodiment, the source driver chip may also be integrated in a display panel.

The display device may include, but is not limited to, a display panel, a mobile phone, a tablet computer, a computer monitor, a display screen, a game console, a television set, a wearable device, and one of other living or household appliances having display functions.

Note that FIGS. 1 to 8 only illustrate and do not limit the invention.

The source driver chip and display device in embodiments of the application include a first pre-charging module configured to pre-charge the first data lines to a first preset voltage and pre-charge the second data lines to a second preset voltage when the voltage of the first data signal is greater than the preset reference voltage, and pre-charge the first data lines to a second preset voltage and the second data lines to the first preset voltage when the voltage of the first data signal is less than the preset reference voltage. The first preset voltage is greater than the second preset voltage. Thus, magnitude of charging voltage surges is reduced, thereby reducing temperature of the source driver chip and preventing damages to the source driver chip.

The source driver chip and the display device provided in embodiments of the present application have been detailed in the forgoing description. Principles and embodiments of the present application have been explained through specific examples herein. The above descriptions of the examples are only for facilitating understanding of the present application. Meanwhile, persons with ordinary skills in the art may modify specific embodiments and applications according to the principles of this application. In view of the above, the contents of this specification should not be construed as a limitation to this application.

What is claimed is:

1. A source driver chip applied to a display panel, wherein the display panel comprises a plurality of first data lines and a plurality of second data lines, the first data lines are configured to input a first data signal, and the second data lines are configured to input a second data signal, the first data lines and the second data lines are interleavingly arranged, and the first data signal and the second data signal are not equal;

wherein the source driver chip comprises:

a first power supply module providing a power supply voltage for a first voltage range;

a second power supply module providing a power supply voltage for a second voltage range, wherein the second voltage range is symmetrical to the first voltage range with respect to a preset reference voltage;

a first pre-charging module configured to pre-charge the first data lines to a first preset voltage and the second data lines to a second preset voltage when a voltage of the first data signal is greater than the preset reference voltage, and pre-charge the first data lines to the second preset voltage and the second data lines to the first preset voltage when the voltage of the first data signal is less than the preset reference voltage, wherein the first preset voltage is greater than the second preset voltage; and a selection module configured to select one of the first power supply module or the second power supply module for connection to the first data lines based on the voltage of the first data signal, and select the other power supply module among the first power supply module or the second power supply module for connection to the second data lines based on a voltage of the second data signal, to charge the first data lines to a first preset target voltage and the second data lines to a second preset target voltage;

wherein the first pre-charging module comprises a first pre-charging unit and a second pre-charging unit;

the first pre-charging unit is configured to pre-charge the first data lines to the first preset voltage and the second data lines to the second preset voltage under control of a first control signal, the first control signal is generated based on a difference between the voltage of the first data signal and the preset reference voltage; and the second pre-charging unit is configured to pre-charge the first data lines to the second preset voltage and the second data lines to the first preset voltage under control of a second control signal, the second control signal is generated based on a difference between the voltage of the second data signal and the preset reference voltage, and the first control signal and the second control signal have opposite levels;

wherein the source driver chip further comprises a second pre-charging module;

the second pre-charging module is configured to charge the first data lines from the first preset voltage to a third preset voltage and the second data lines from the second preset voltage to a fourth preset voltage when the voltage of the first data signal is greater than the preset reference voltage, and charge the first data lines from the second preset voltage to the fourth preset voltage and charge the second data lines from the first preset voltage to the third preset voltage when the voltage of the first data signal is less than the preset reference voltage;

wherein the third preset voltage is greater than the first preset voltage, the fourth preset voltage is greater than the second preset voltage, and the fourth preset voltage is less than the third preset voltage;

wherein the source driver chip further comprises a third pre-charging module;

the third pre-charging module is configured to charge the first data lines from the third preset voltage to a fifth preset voltage and the second data lines from the fourth preset voltage to a sixth preset voltage when the voltage of the first data signal is greater than the preset reference voltage; and charge the first data lines from the fourth preset voltage to the sixth preset voltage and the second data lines from the third preset voltage to the fifth preset voltage when the voltage of the first data signal is less than the preset reference voltage;

wherein the fifth preset voltage is greater than the third preset voltage, the sixth preset voltage is greater than the fourth preset voltage, and the sixth preset voltage is less than the fifth preset voltage;

wherein the third pre-charging module of the source driver chip further comprises a fifth pre-charging unit and a sixth pre-charging unit;

the fifth pre-charging unit is configured to charge the first data lines from the third preset voltage to the fifth preset voltage and the second data lines from the fourth preset voltage to the sixth preset voltage under control of the first control signal; and the fourth pre-charging unit is configured to charge the first data lines from the fourth preset voltage to the sixth preset voltage and the second data lines from the third preset voltage to the fifth preset voltage under control of the second control signal.

2. The source driver chip of claim 1, wherein the first pre-charging unit comprises a first switch element and a second switch element;

an input terminal of the first switch element is connected to the first preset voltage, an output terminal of the first switch element is connected to the first data lines, and a control terminal of the first switch element and a control terminal of the second switch element are connected to the first control signal; and an input terminal of the second switch element is connected to the second preset voltage, and an output of the second switch element is connected to the second data lines.

3. The source driver chip of claim 2, wherein the first pre-charging unit further comprises a third switch element and a fourth switch element;

an input terminal of the third switch element is connected to the second preset voltage, and an output terminal of the third switch element is connected to the first data lines; and an input terminal of the fourth switch element is connected to the first preset voltage, and an output terminal of the fourth switch element is connected to the second data lines.

4. The source driver chip of claim 3, wherein when the voltage of the first data signal is greater than the preset reference voltage, the first control signal is at an effective voltage level, and the second control signal is at an ineffective voltage level; and when the voltage of the second data signal is greater than the preset reference voltage, the second control signal is at the effective voltage level, and the first control signal is at the ineffective voltage level.

5. The source driver chip of claim 1, wherein the second pre-charging module comprises a third pre-charging unit and a fourth pre-charging unit;

the third pre-charging unit is configured to charge the first data lines from the first preset voltage to the third preset voltage and the second data lines from the second preset voltage to the fourth preset voltage under control of the first control signal; and the fourth pre-charging unit is configured to charge the first data lines from the second preset voltage to the fourth preset voltage and the second data lines from the first preset voltage to the third preset voltage under control of the second control signal.

6. The source driver chip of claim 5, wherein the third pre-charging unit comprises a fifth switch element and a sixth switch element;

an input terminal of the fifth switch element is connected to the third preset voltage, an output terminal of the fifth switch element is connected to the first data lines, and a control terminal of the fifth switch element and a control terminal of the sixth switch element are both connected to the first control signal; and an input terminal of the sixth switch element is connected to the fourth preset voltage, and an output terminal of the sixth switch element is connected to the second data lines.

7. The source driver chip of claim 6, wherein the fourth pre-charging unit comprises a seventh switch element and an eighth switch element;

an input terminal of the seventh switch element is connected to the fourth preset voltage, a control terminal of the seventh switch element and a control terminal of the eighth switch element are connected to the second control signal, and an output terminal of the seventh switch element is connected to the first data lines; and an input terminal of the eighth switch element is connected to the third preset voltage, and an output terminal of the eighth switch element is connected to the second data lines.

8. The source driver chip of claim 7, wherein when the voltage of the first data signal is greater than the voltage of the second data signal, the fifth switch element and the sixth switch element are closed, and the seventh switch element and the eighth switch element are opened;

when the voltage of the first data signal is less than the voltage of the second data signal, the fifth switch element and the sixth switch element are opened, and the seventh switch element and the eighth switch element are closed.

9. The source driver chip of claim 1, wherein:

the fifth pre-charging unit may comprise a thirteenth switch element and a fourteenth switch element;

an input terminal of the thirteenth switch element is connected to the fifth preset voltage, and output terminal of the thirteenth switch element is connected to the first data lines, a control terminal of the thirteenth switch element and a control terminal of the fourteenth switch element are connected to the first control signal; and an input terminal of the fourteenth switch element is connected to the sixth preset voltage, and an output terminal of the fourteenth switch element is connected to the second data lines.

10. The source driver chip of claim 1, wherein:

the sixth pre-charging unit comprises a fifteenth switch element and a sixteenth switch element;

an input terminal of the fifteenth switch element is connected to the sixth preset voltage, a control terminal of the fifteenth switch element and a control terminal of the sixteenth switch element are connected to the second control signal, and an output terminal of the fifteenth switch element is connected to the first data lines; and an input terminal of the sixteenth switch element is connected to the fifth preset voltage, and an output terminal of the sixteenth switch element is connected to the second data lines.

11. A display device comprising a source driver chip applied to a display panel, wherein the display panel comprises a plurality of first data lines and a plurality of second data lines, the first data lines are configured to input a first data signal, and the second data lines are configured to input a second data signal, the first data lines and the second data lines are interleavingly arranged, and the first data signal and the second data signal are not equal;

wherein the source driver chip comprises:

a first power supply module providing a power supply voltage for a first voltage range;

a second power supply module providing a power supply voltage for a second voltage range, wherein the second voltage range is symmetrical to the first voltage range with respect to a preset reference voltage;

a first pre-charging module configured to pre-charge the first data lines to a first preset voltage and the second data lines to a second preset voltage when a voltage of the first data signal is greater than the preset reference voltage, and pre-charge the first data lines to the second preset voltage and the second data lines to the first preset voltage when the voltage of the first data signal is less than the preset reference voltage, wherein the first preset voltage is greater than the second preset voltage; and a selection module configured to select one of the first power supply module or the second power supply module for connection to the first data lines based on the voltage of the first data signal, and select the other power supply module among the first power supply module or the second power supply module for connection to the second data lines based on a voltage of the second data signal, to charge the first data lines to a first preset target voltage and the second data lines to a second preset target voltage;

wherein the first pre-charging module comprises a first pre-charging unit and a second pre-charging unit;

the first pre-charging unit is configured to pre-charge the first data lines to the first preset voltage and the second data lines to the second preset voltage under control of a first control signal, the first control signal is generated based on a difference between the voltage of the first data signal and the preset reference voltage; and the second pre-charging unit is configured to pre-charge the first data lines to the second preset voltage and the second data lines to the first preset voltage under control of a second control signal, the second control signal is generated based on a difference between the voltage of the second data signal and the preset reference voltage, and the first control signal and the second control signal have opposite levels;

wherein the source driver chip further comprises a second pre-charging module;

the second pre-charging module is configured to charge the first data lines from the first preset voltage to a third preset voltage and the second data lines from the second preset voltage to a fourth preset voltage when the voltage of the first data signal is greater than the preset reference voltage, and charge the first data lines from the second preset voltage to the fourth preset voltage and charge the second data lines from the first preset voltage to the third preset voltage when the voltage of the first data signal is less than the preset reference voltage;

wherein the third preset voltage is greater than the first preset voltage, the fourth preset voltage is greater than the second preset voltage, and the fourth preset voltage is less than the third preset voltage;

wherein the source driver chip further comprises a third pre-charging module;

the third pre-charging module is configured to charge the first data lines from the third preset voltage to a fifth preset voltage and the second data lines from the fourth preset voltage to a sixth preset voltage when the voltage of the first data signal is greater than the preset reference voltage; and charge the first data lines from the fourth preset voltage to the sixth preset voltage and the second data lines from the third preset voltage to the fifth preset voltage when the voltage of the first data signal is less than the preset reference voltage;

wherein the fifth preset voltage is greater than the third preset voltage, the sixth preset voltage is greater than the fourth preset voltage, and the sixth preset voltage is less than the fifth preset voltage;

wherein the third pre-charging module of the source driver chip further comprises a fifth pre-charging unit and a sixth pre-charging unit;

the fifth pre-charging unit is configured to charge the first data lines from the third preset voltage to the fifth preset voltage and the second data lines from the fourth preset voltage to the sixth preset voltage under control of the first control signal; and the fourth pre-charging unit is configured to charge the first data lines from the fourth preset voltage to the sixth preset voltage and the second data lines from the third preset voltage to the fifth preset voltage under control of the second control signal.

12. The display device of claim 11, wherein the first pre-charging unit comprises a first switch element and a second switch element;

an input terminal of the first switch element is connected to the first preset voltage, an output terminal of the first switch element is connected to the first data lines, and a control terminal of the first switch element and a control terminal of the second switch element are connected to the first control signal; and an input terminal of the second switch element is connected to the second preset voltage, and an output of the second switch element is connected to the second data lines.

13. The display device of claim 12, wherein the first pre-charging unit further comprises a third switch element and a fourth switch element;

an input terminal of the third switch element is connected to the second preset voltage, and an output terminal of the third switch element is connected to the first data lines; and an input terminal of the fourth switch element is connected to the first preset voltage, and an output terminal of the fourth switch element is connected to the second data lines.

14. The display device of claim 13, wherein when the voltage of the first data signal is greater than the preset reference voltage, the first control signal is at an effective voltage level, and the second control signal is at an ineffective voltage level; and when the voltage of the second data signal is greater than the preset reference voltage, the second control signal is at the effective voltage level, and the first control signal is at the ineffective voltage level.

* * * * *